US009728081B2

(12) United States Patent
Helmy et al.

(10) Patent No.: US 9,728,081 B2
(45) Date of Patent: Aug. 8, 2017

(54) BLUETOOTH WIRELESS NETWORK FOR INFRARED ELECTRONIC DEVICES

(71) Applicants: Barnabas Helmy, Springfield, IL (US); Andrew Brown, Chatham, IL (US)

(72) Inventors: Barnabas Helmy, Springfield, IL (US); Andrew Brown, Chatham, IL (US)

(73) Assignee: SMASHTOAST, Inc.

( * ) Notice: Subject to any disclaimer, the term of this patent is extended or adjusted under 35 U.S.C. 154(b) by 0 days.

(21) Appl. No.: 14/658,209

(22) Filed: Mar. 15, 2015

(65) Prior Publication Data

US 2015/0262475 A1 Sep. 17, 2015

Related U.S. Application Data

(60) Provisional application No. 61/953,923, filed on Mar. 16, 2014.

(51) Int. Cl.
*G08C 17/02* (2006.01)
*G08C 23/04* (2006.01)

(52) U.S. Cl.
CPC ..... *G08C 17/02* (2013.01); *G08C 23/04* (2013.01); *G08C 2201/42* (2013.01)

(58) Field of Classification Search
CPC ..... G08C 17/02; G08C 23/04
USPC ..... 340/12.3
See application file for complete search history.

(56) References Cited

U.S. PATENT DOCUMENTS 5,787,361 A * 7/1998 Chen ..... H04M 1/0262 429/97
6,046,515 A * 4/2000 Lewis ..... C23F 13/00 204/196.05
7,987,489 B2 7/2011 Krzyzanowski et al.
8,233,803 B2 7/2012 Meyer et al.
2006/0038554 A1* 2/2006 Kurita ..... G01R 31/305 324/750.19
2006/0219652 A1* 10/2006 Grant ..... B65D 55/16 215/237
2009/0121905 A1* 5/2009 Griffin, Jr. ..... G08C 17/02 341/35
2012/0082461 A1* 4/2012 Meyer et al. ..... G08C 17/02 398/106

(Continued)

OTHER PUBLICATIONS

U.S. Appl. No. 13/551,624, filed Jun. 20, 2013, Hsieh et al.

(Continued)

*Primary Examiner* — Yong Hang Jiang
(74) *Attorney, Agent, or Firm* — Law Office of Robert M. Patino

(57) ABSTRACT

A wireless network for providing commands to a plurality of electronic devices that receive an infrared signal is provided with an at least one sprocket for receiving a wireless transmission command via Bluetooth signals and/or infrared signals and a Bluetooth remote for sending the Bluetooth signal to the at least one sprocket. The Bluetooth remote is provided with a Bluetooth remote power source, a software application for providing command logic to the Bluetooth remote, and a Bluetooth signal transmitter. The at least one sprocket is provided with a sprocket shell housing, a corresponding sprocket lid, and a sprocket command assembly that is housed by the sprocket shell housing and the corresponding sprocket lid.

15 Claims, 10 Drawing Sheets

(56) References Cited

U.S. PATENT DOCUMENTS

| | | | | |
|---|---|---|---|---|
| 2013/0122748 | A1* | 5/2013 | Rapisarda | A43B 3/001 439/629 |
| 2013/0300574 | A1* | 11/2013 | Gillette, II | G01N 33/0009 340/870.01 |

OTHER PUBLICATIONS

U.S. Appl. No. 13/954,224, filed Dec. 12, 2013, Du et al.
www.anymote.io (webpages attached, date unknown).
www.logitech.com/en-us/product/harmony-elite (webpages attached, date unknown).

* cited by examiner

BLUETOOTH WIRELESS NETWORK FOR INFRARED ELECTRONIC DEVICES

CROSS-REFERENCE TO RELATED APPLICATION

This application claims the benefit of U.S. Provisional Application 61/953,923 filed Mar. 16, 2014.

BACKGROUND OF THE INVENTION

The present invention is in the technical field of a wireless network, and more particularly, the present invention is in the technical field of smart hardware devices and corresponding software that enables a plurality of infrared receiving devices to receive commands from one device via Bluetooth.

Present devices such as televisions, stereos, receivers, cable boxes, satellite boxes, and other entertainment devices use infrared signals (an IR LED) from remote controls (referred to as "infrared remotes" hereinafter) to receive commands on how to perform. These commands might include "on/off" commands, volume or channel commands, input commands, sound balance and equalizing commands, light dimming commands and many other types of commands. Having more than just one device in a room that is reliant on infrared signaling often requires a plurality of remotes to be used. It can be extremely inconvenient for the remote user to constantly locate the correct infrared remote for the commands that he desires from an entertainment system, light fixture or other electronic device. Furthermore, having a plurality of remotes will often result in one or more infrared remote to be lost or damaged. Infrared remotes can fall into the crevices of a couch or recliner. Infrared remotes can be stepped on or tripped on if fallen on the floor. The damage infrared remotes will have to be replaced and this costs the user money. Furthermore, have a plurality of infrared remotes often clutters up a coffee table or other table that could better utilize the space with decorations or tea trays.

Another problem with infrared remotes is that infrared remotes require a direct line of sight to the device with the infrared receiving sensor (referred to as "IR receiver(s) of the electronic device(s)"). These IR receivers of the electronic devices are often placed under small dark translucent windows located in the bottom corner of a television or on a cable box, light fixture, stereo receiver, etc. If an obstruction such as a person or object is located between the line of sight between the infrared remote and the IR receiver of the electronic device, the infrared remote will not work. This line of sight can become obstructed with people constantly moving through a room. Finding the correct line of sight can become a chore when the IR receiver of the electronic device is located in an opposite area of the room from the other electronic devices with an IR receiver. Thus, the infrared remote will fail to work 100% of the time when there is an obstruction in the line of sight or the line of sight is not correct.

Another shortcoming with the infrared remotes is that there is an inability to capture important behavior information. Behavior information might include information that the user turns his television on at 6:00 pm most nights to watch a particular news program. The user often turns off his entertainment system at 8:00 PM and does not engage the entertainment system until 6:00 AM the next morning. The user turns off his lights at 9:00 PM every night. This information, among other information, is very valuable for marketing professionals attempting to launch new products and services.

Universal infrared remotes have been utilized for a number of years and attempt to address some of these issues. Universal infrared remotes are often able to combine several remote functions found in a typical entertainment system into one remote control. The typical entertainment system might include a stereo, cable box and television for example. However, the universal infrared remote is deficient in several areas as indicated above in requiring a line of sight to operate, having a limited utility in the types of devices that it will handle, and there is a general lack of user data that can be captured and utilized by companies that desire to harvest behavior information.

There have been attempts to make a wireless network using a "smart device" such as a phone, tablet or other Bluetooth enabled device. One such example is the Logitech Harmony Ultimate that uses a Harmony Hub to convert the IR commands from a remote into RF commands to be received by a device. In this device, the Harmony Hub must be plugged in to receive sufficient power to enable the device. The Harmony Hub also uses "mini-blasters" that are wired into the Harmony Hub to allow the use for multiple devices that may or may not be hidden inside a cabinet. The mini blasters are plugged into the Harmony Hub for power and signaling. Besides being very expensive to purchase, the use of wires is a limiting feature of the Logitech Harmony Ultimate for power and signaling. The set-up is bulky and clumsy to accommodate all of the wires.

Another such unit that may be used with a smart device is an "Anymote" that was launched from a Kickstarter campaign. The Anymote converts Bluetooth® into an IR signal and often sits on a coffee table. The Anymote sprays out the IR signal or signals across the room and relies heavily on "line of sight" to work properly. The disadvantage of the Anymote is its positioning requirements prevent it from being used with devices that are behind doors or within a cabinet.

Thus, there is a need for a wireless network that eliminates the need of utilizing an infrared remote and eliminates the needs for line of sight command signaling. Furthermore, there is a need for a wireless network that can be utilized for a plurality of electronic devices throughout a room and are not limited by requiring an electronic wire to function. Moreover, there is a need for a wireless network that can capture behavior information while using the wireless network.

SUMMARY OF THE INVENTION

The above needs are met by the present invention. The wireless network in the present invention eliminates the need of using a plurality of infrared remotes and eliminates the need for line of sight command signaling. Furthermore, the wireless network in the present invention allows the use of one device that can send command signals to a plurality of electronic devices throughout a room without the use of wires to connect mini-blasters. Moreover, the wireless network in the present invention is capable of capturing behavior information when the user is using the wireless network.

The present wireless network provides commands to a plurality of electronic devices by leveraging an at least one sprocket and a Bluetooth remote. The at least one sprocket is configured to receive a wireless transmission command via Bluetooth technology. The at least one sprocket is provided with sprocket shell housing and a sprocket lid, an antenna and Bluetooth module for receiving and processing a Bluetooth signal, an infrared LED to send an infrared signal, a sprocket power source to provide power, and a sprocket command assembly for processing commands received by the Bluetooth signal. The Bluetooth remote for sending the Bluetooth signal to the at least one sprocket is provided with a Bluetooth remote power source, a software application for providing command logic to the Bluetooth remote, and a Bluetooth signal transmitter.

DETAILED DESCRIPTION

Figure 5:
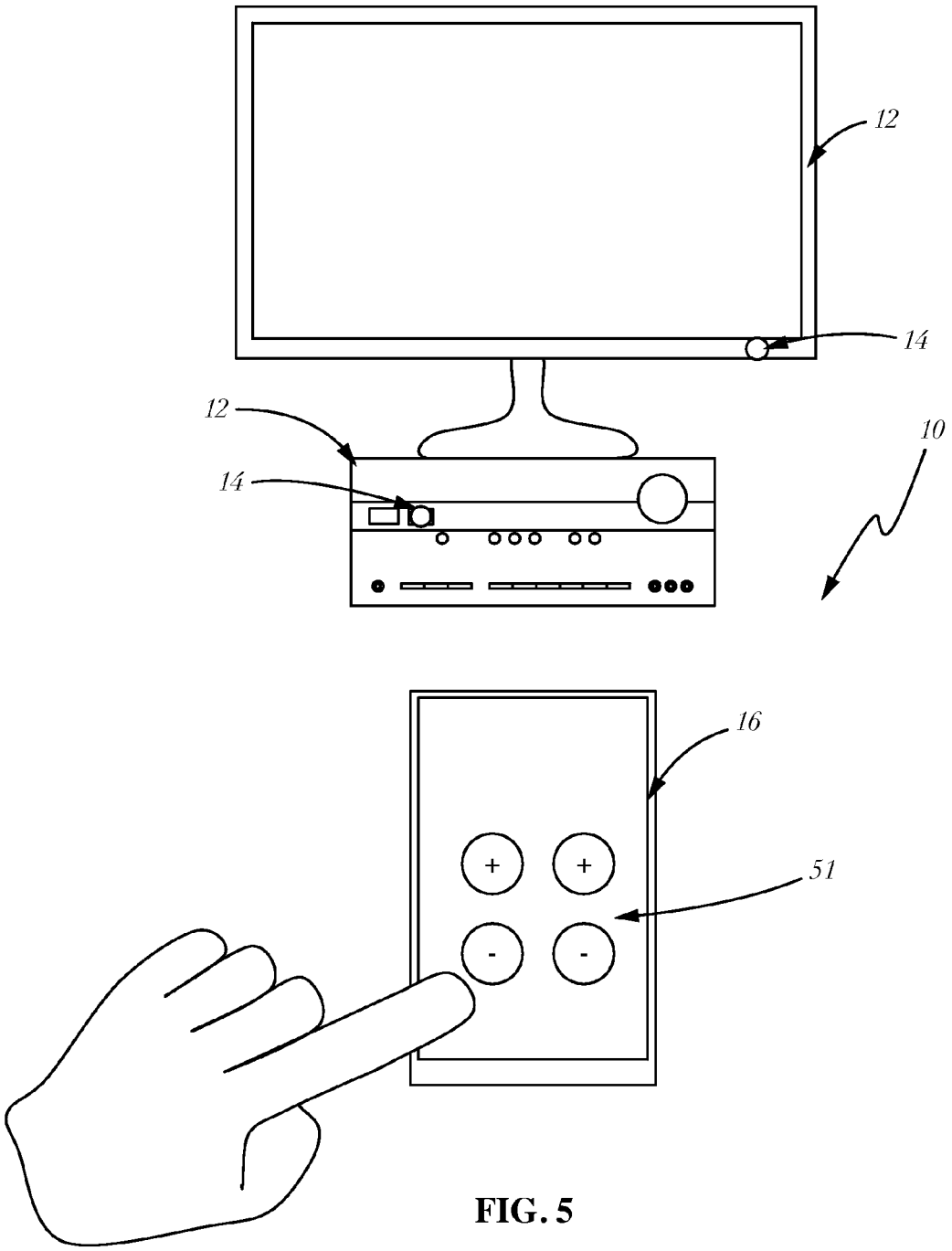
FIG. 5 is an illustration of a Bluetooth remote being operated to control an entertainment system wherein each electronic device is operated by a mounted sprocket.

Referring to FIG. 5, the present invention is a wireless network 10 for providing commands to a plurality of electronic devices 12 devices that receive an infrared signal. The electronic devices 12 may be a stereo receiver, television, cable box, equalizer, light fixture or other electronic device within a room that is capable of receiving a command via an infrared signal. The wireless network 10 is composed of two main components, an at least one sprocket 14 for receiving a wireless transmission command via Bluetooth technology and a Bluetooth remote 16 for sending a Bluetooth signal to the at least one sprocket 14. The at least one sprocket 14, which may also be referred to as a puck or PUCK™, is defined as a type of interface device that allows a user to communicate with an electronic device 12 through a Bluetooth remote 16 or other smart remote device such as a mobile phone, tablet, computer or an enabled remote control. The at least one sprocket 14, is optionally designed to receive an infrared signal to accommodate receiving and learning commands from a remote with an IR emitter (see FIG. 10). Each of these components will be described in detail.

Bluetooth technology leverages short-wavelength UHF radio waves to build a personal area network. The typical ISM band used is from 2.4 to 2.485 GHz. Consumer electronics have been using Bluetooth technology for some time and has been used quite extensively with mobile phones to communicate with computers. What makes this technology unique is that it applies the Bluetooth technology and converts the UHF radio waves generated by the Bluetooth remote into a useable IR LED or infrared signal that can transmit a command to the electronic device 12 that uses an LED sensor without the aid of an electrical outlet source of power. Although many electronic devices 12 come with Bluetooth technology built in, many still rely on the classic LED remote that requires a direct line of sight with the devices to transmit a command.

Figure 10:
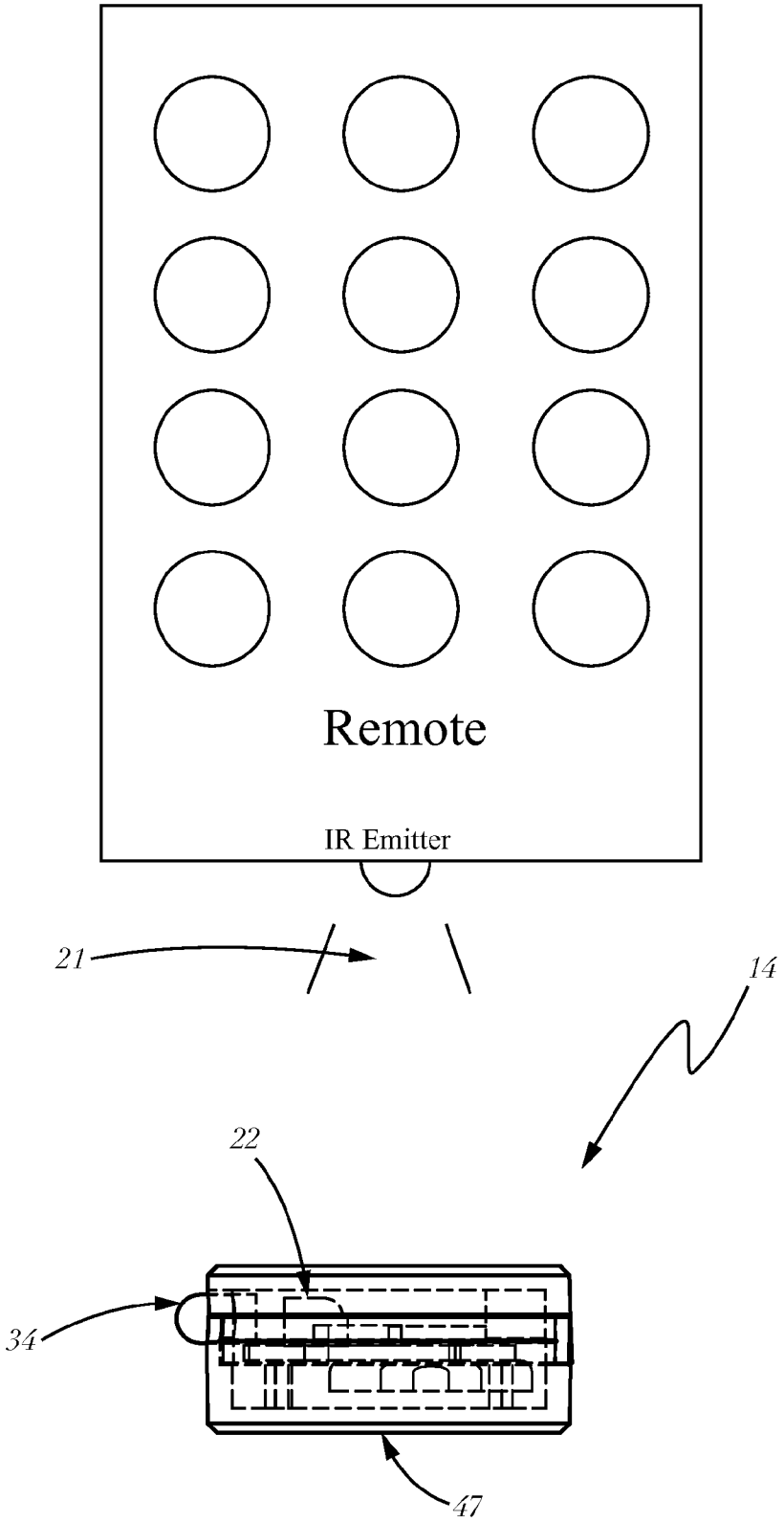
FIG. 10 is a side, transparent view of the at least one sprocket in the alternative embodiment located with a standard remote with an IR emitter.

Referring to FIGS. 1-4 and FIGS. 6-9, the at least one sprocket 14 is provided with sprocket shell housing 18 and a corresponding sprocket lid 20. The sprocket shell housing 18 and sprocket lid 20 are preferably made with a moldable plastic but may be constructed of another durable material such as metal (I.e. aluminum), ceramic or glass. In the preferred embodiment, the sprocket lid 20 is transparent and is made of a transparent polycarbonate. However, in an alternative embodiment, the sprocket lid 20 may be provided with a lid sprocket window 40 or may be partially transparent to accommodate the transmission of a remote infrared signal 21 (as shown in FIG. 10). In these embodiments, the sprocket lid 20 is at least partly transparent on some part of the sprocket lid 20 to allow for the receipt of the remote infrared signal 21 from outside the sprocket 14 to be received by an infrared receiver module 22. The sprocket lid 20 is received by the sprocket shell housing 18 and is provided with a means of securely attaching to one another. This means of securely attaching the sprocket lid 20 to the shell housing 18 may be achieved by snapping on, screwing on, or adhering together or other means of connecting with an appropriate configuration of the two parts. The means of securely attaching the sprocket lid 20 to the shell housing 18 should be strong enough to prevent the unintentional opening of the sprocket lid 20 and the sprocket shell housing 18 as a sprocket command assembly 24 (also referred to as a logic board) is housed inside the two parts. In the preferred embodiment, the means of securely attaching the corresponding sprocket lid 20 to the sprocket shell housing 18 is provided by a snap fit ring 25 and a corresponding snap fit impression 26. The snap fit ring 25 fits securely into the corresponding snap fit impression 26 when the sprocket lid 20 and sprocket shell housing 18 are closed together.

In one embodiment, sprocket shell housing 18 and the sprocket lid 20 have a cylindrical structure. This shape gives the at least one sprocket 14 an aesthetic and functional design. The at least one sprocket 14 is easy to handle and can easily be placed on the electronic device 12. Furthermore, the at least one sprocket 14 should be small in size to be used in cramped places such as a cabinet or shelving unit. The small size will also improve the use of the at least one sprocket 14 if the at least one sprocket 14 were placed on the electronic device 12 itself so that the at least one sprocket 14 does not obstruct the view of a television screen or other features that might exist on the electronic device 12. The size of the at least one sprocket 14 should be between 0.5 inches and 5 inches in diameter of the at least one sprocket or width if the at least one sprocket 14 embodies a shape other than a sphere. More preferably, the size of the at least one sprocket 14 should be between 1 inch and 3 inches in diameter of the at least one sprocket 14 or width if the at least one sprocket 14 embodies a shape other than a sphere. The at least one sprocket 14 may optionally be between 1.25 inches and 2 inches in diameter of the at least one sprocket or width if the at least one sprocket 14 embodies a shape other than a sphere. The height of the at least one sprocket 14 should be between 0.2 inches and 2 inches in height when the sprocket shell housing 18 and the sprocket lid 20 are combined. More preferably, the height of the at least one sprocket 14 should be between 0.4 inches and 1 inch.

It is important that the sprocket command assembly 24 fits securely within the at least one sprocket 14 so that the components within the sprocket command assembly 24 still function in the event the at least one sprocket 14 experiences trauma such as a sudden fall, shaking behavior or other insult. Now referring to FIGS. 6 and 7, the sprocket shell housing 18 is provided with a set of stabilizing ribs 27 that correspond to a battery case 28 designed to house a sprocket power source 33. The set of stabilizing ribs 27 assist in ensuring that there is no downward movement of the sprocket command assembly 24. To further assist in the stabilization of the sprocket command assembly 24, sprocket shell housing 18 is further provided with a lower sprocket command assembly support tab 29 that supports the lower side of a front end of the sprocket command assembly 24. To assist with the stabilization from the upper side of the sprocket command assembly 24, the corresponding sprocket lid 20 is provided with an upper sprocket command assembly support tab 30.

Figure 1A:
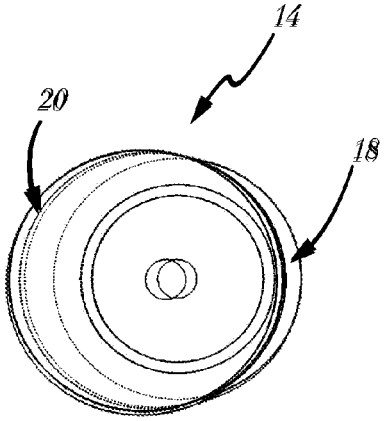
FIG. 1*a* is a top perspective view of a sprocket shell housing.
Figure 1B:
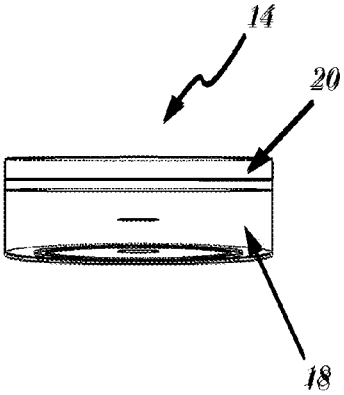
FIG. 1*b* is a side perspective view of the sprocket shell housing.
Figure 1C:
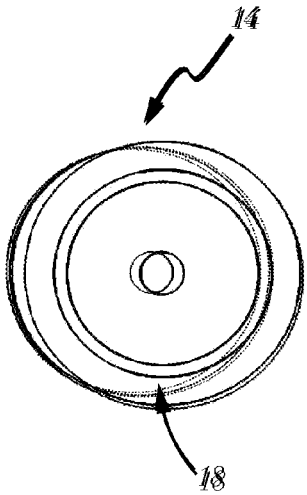
FIG. 1*c* is a bottom perspective view of the sprocket shell housing.
Figure 2:
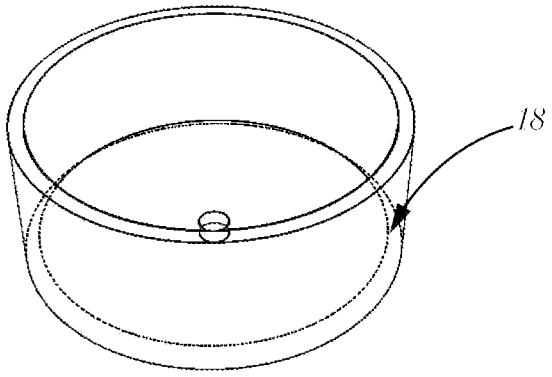
FIG. 2 is a top perspective view of the sprocket shell housing without a sprocket lid.
Figure 3A:
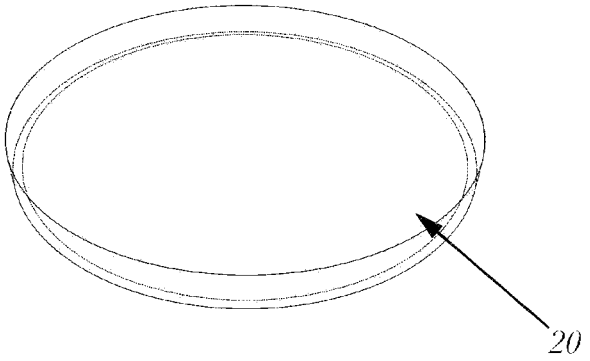
FIG. 3*a* is a top perspective view of the sprocket lid.
Figure 3B:
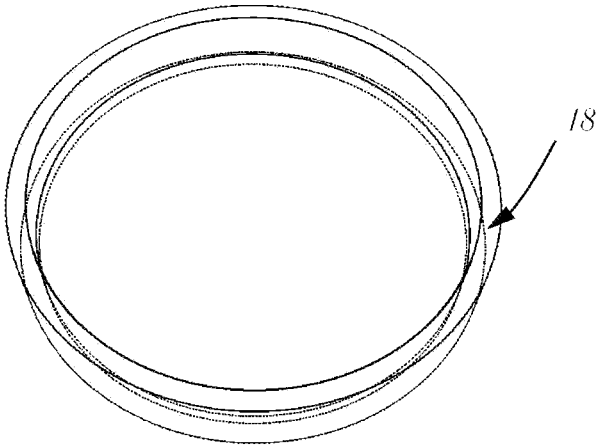
FIG. 3*b* is a top perspective view of the sprocket shell housing without a sprocket lid.
Figure 4:
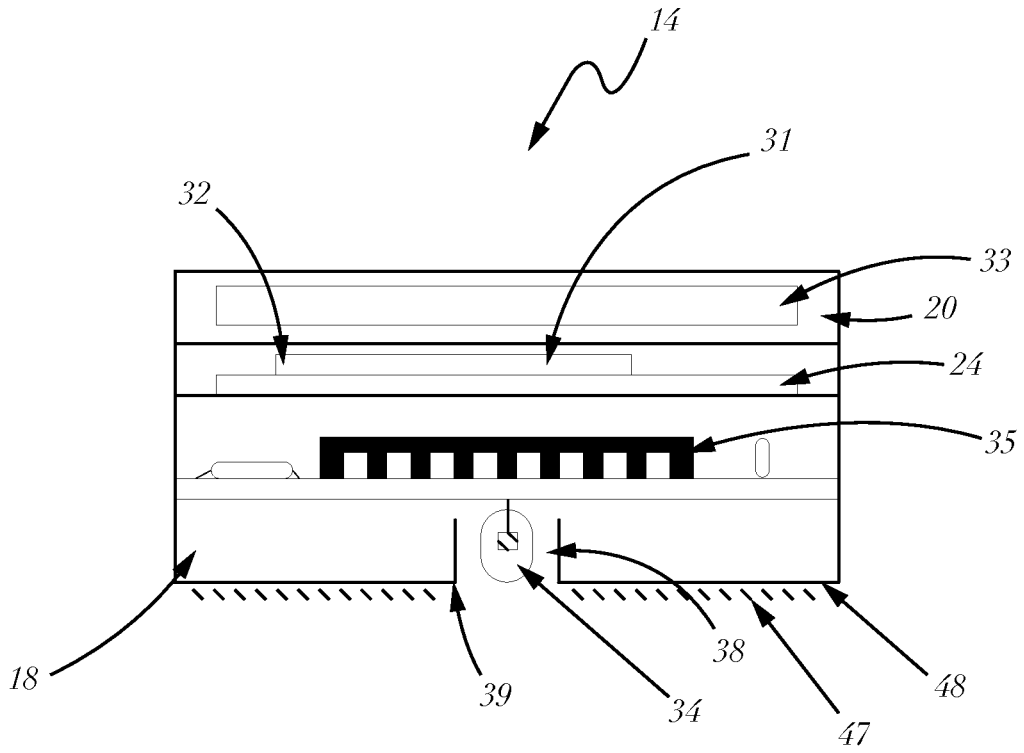
FIG. 4 is a cross-sectional side view of an at least one sprocket.

Now referring to FIG. 4, an antenna 31 is also provided and is located in operational proximity to a Bluetooth module 32 for receiving and processing the Bluetooth signal. The antenna 31 could be located at an internal location found within the sprocket shell housing 18 and sprocket lid 20; however, in one embodiment, the antenna 31 resides external to the sprocket shell housing 18. In this embodiment, the antenna 31 is made of an RF conducting material such as a metal alloy and may be placed between the sprocket shell housing 18 and sprocket lid 20. The shape of the antenna 31 is then dictated by the shape of the sprocket shell housing 18 and sprocket lid 20. If the sprocket shell housing 18 and the sprocket lid 20 are cylindrical in shape as shown in FIG. 4, then the antenna 31 would be circular. If the two parts are square in design, then the antenna 31 would be square. The sprocket shell housing 18 or the sprocket lid 20 would then be molded to accommodate the antenna 31 by being narrower than the diameter or circumference of the antenna 31.

Figure 6:
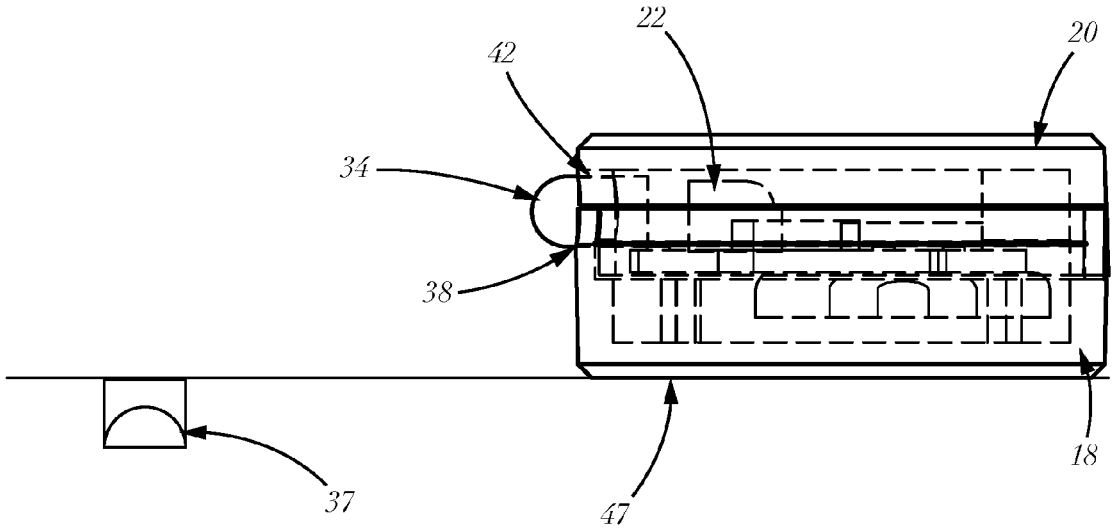
FIG. 6 is a side, transparent view of the at least one sprocket in an alternative embodiment on an electronic device with an IR receiver.
Figure 7:
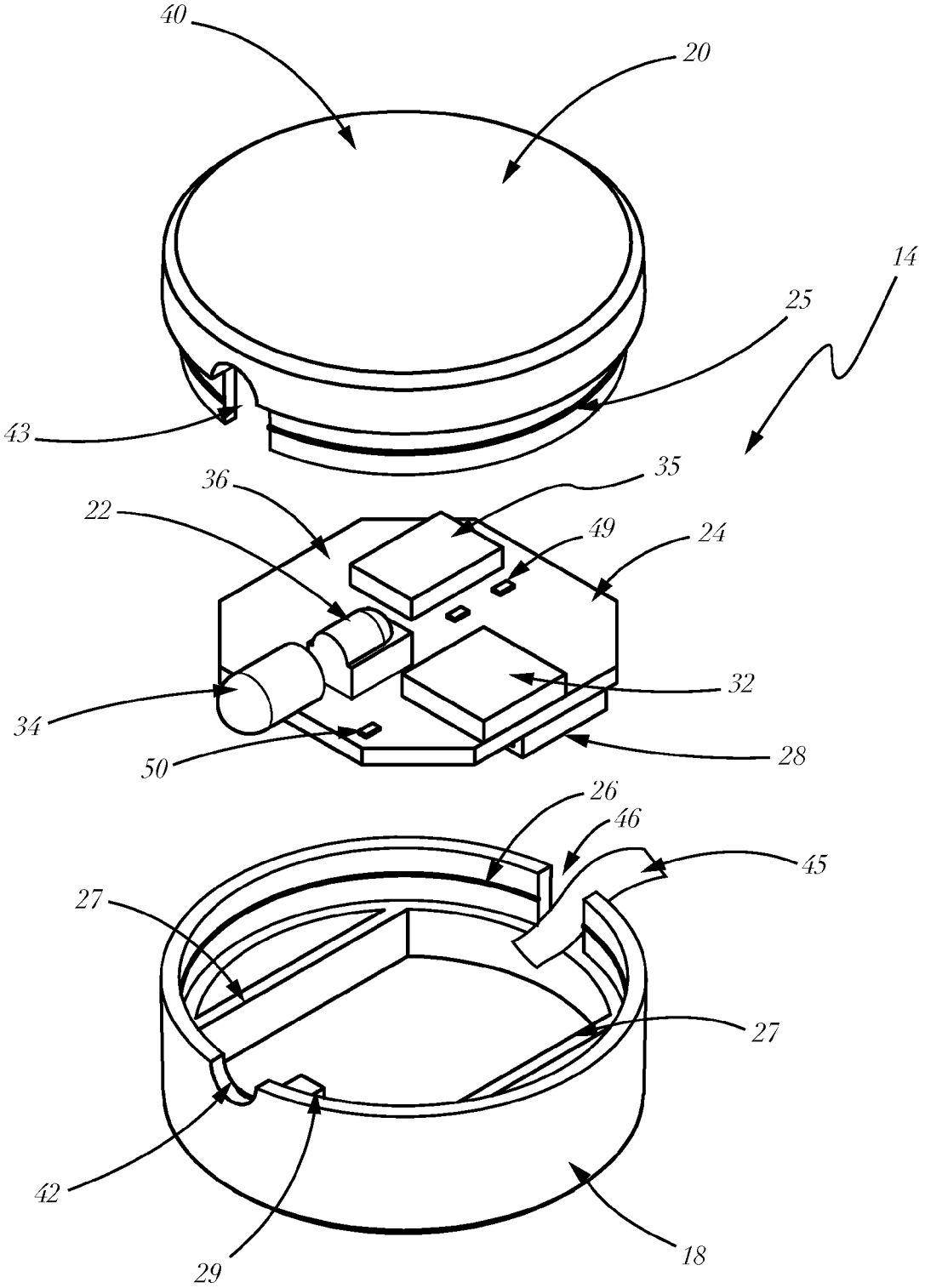
FIG. 7 is an exploded perspective view of the at least one sprocket in the alternative embodiment with the sprocket shell housing and the sprocket lid detached and a sprocket command assembly located in between the sprocket shell housing and the sprocket lid.
Figure 8:
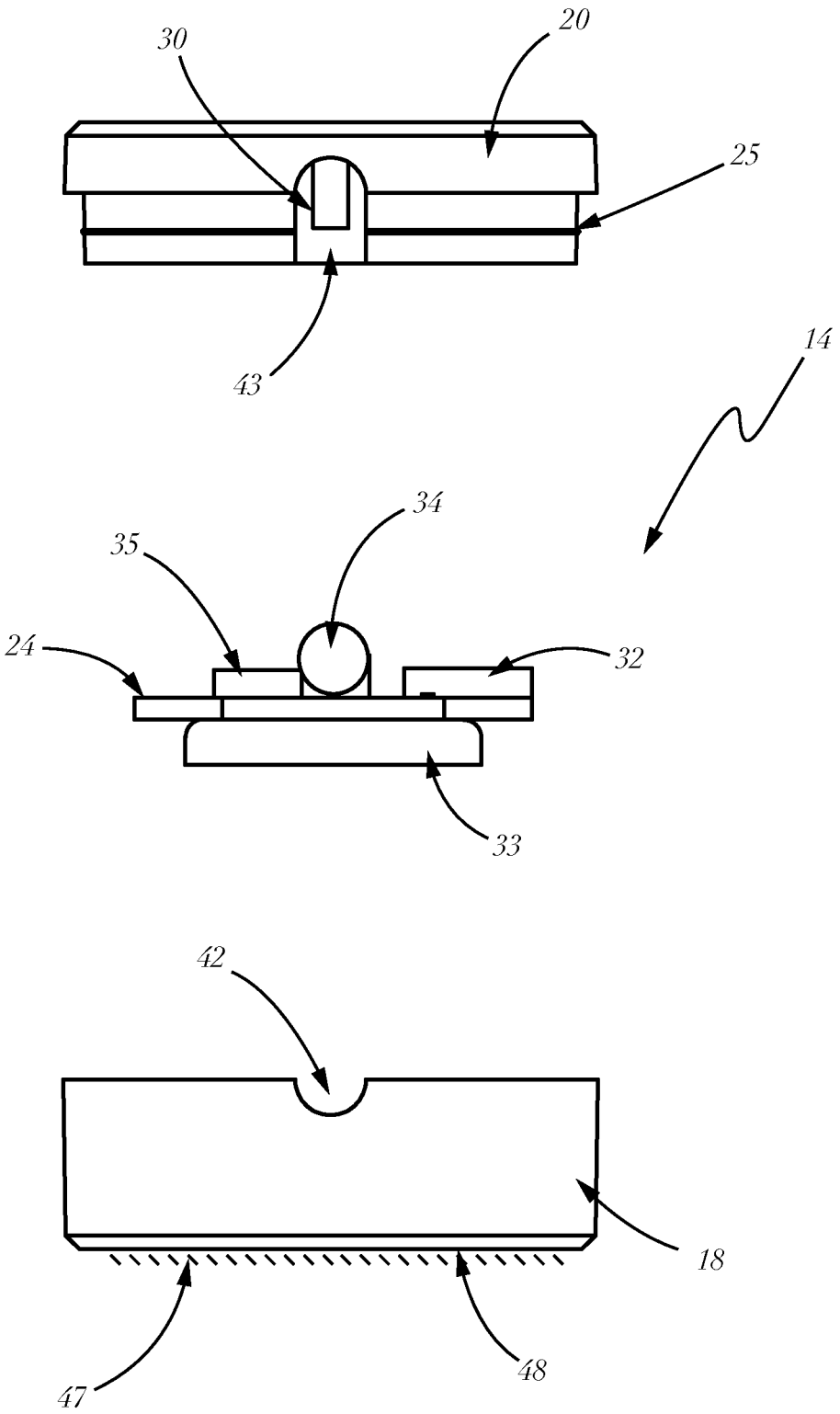
FIG. 8 is a front planar view of the at least one sprocket in the alternative embodiment with the sprocket shell housing and the sprocket lid detached and the sprocket command assembly located in between the sprocket shell housing and the sprocket lid.
Figure 9:
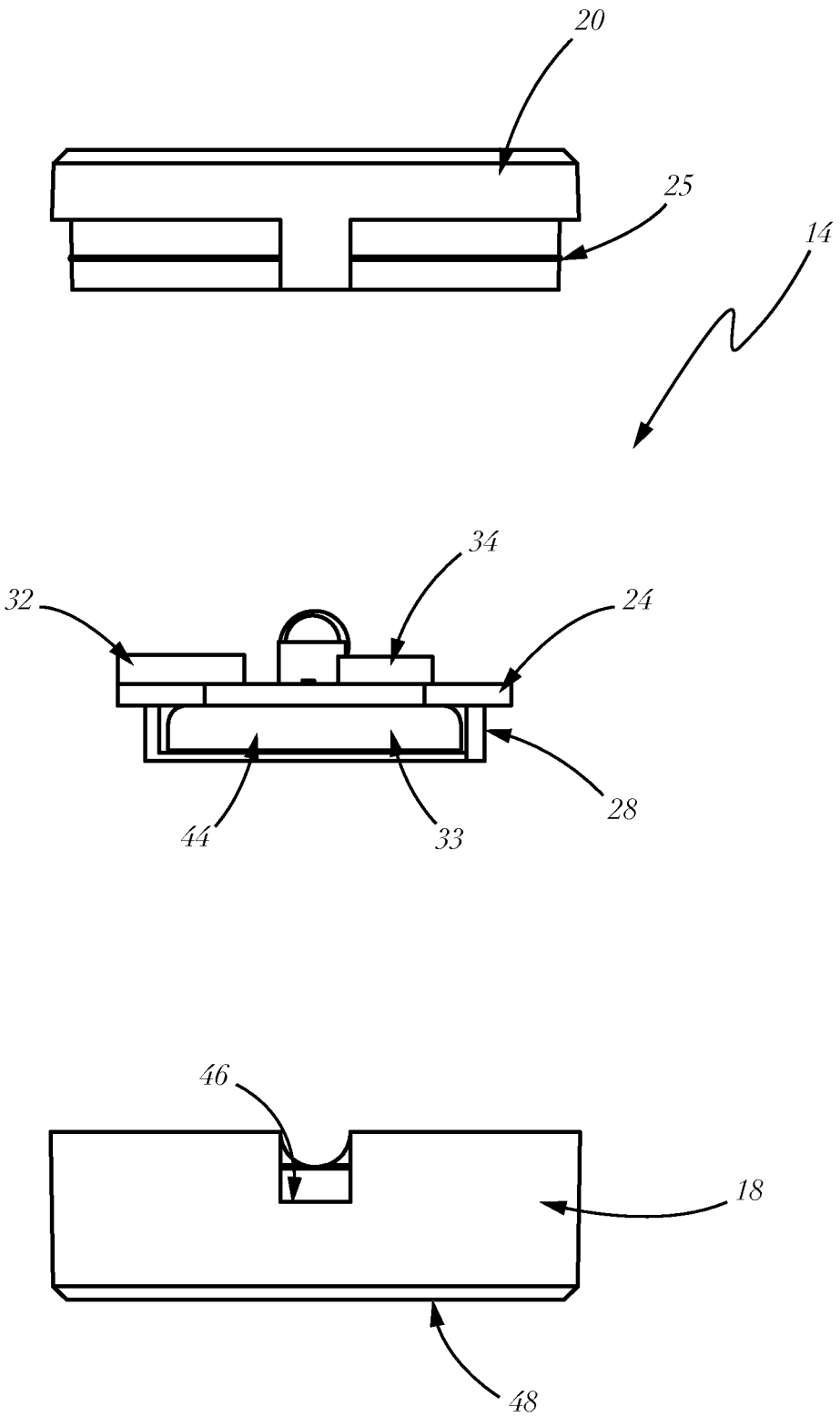
FIG. 9 is a rear planar view of the at least one sprocket in the alternative embodiment with the sprocket shell housing and the sprocket lid detached and the sprocket command assembly located in between the sprocket shell housing and the sprocket lid.

The Bluetooth module 32 processes the Bluetooth signal captured by the antenna 31 and sends the information to the sprocket command assembly 24 or logic board for processing commands sent by the Bluetooth remote 16. In some instances, the antenna may be embedded with the Bluetooth module 32 as shown in FIG. 7. As such, it is important that the Bluetooth module 32 be in proximate relationship to the infrared receiver module 22. The Bluetooth module 32 is small enough to reside within the sprocket shell housing 18 and is small enough to accommodate the sprocket command assembly 24 or logic board, the sprocket power source 33 and an infrared LED emitter 34. Bluetooth modules can be commercially purchased such as SPBT2632C2A from STMicroelectronics or Bluetooth modules can be customized by a technician. Effectively, the Bluetooth module 32 converts the Bluetooth signal into data that can be utilized by the logic board (the logic board converts that Bluetooth data into data that can be transmitted via the infrared LED emitter 34 and utilized by the IR receiver of the electronic device 37 as shown in FIG. 6).

It is also well known that Bluetooth modules 32 come standard with built in antennas so it may not be necessary to have the antenna 31 on the outside of the sprocket shell housing 18 and sprocket lid 20 as described previously. A Bluetooth Low-Energy (BLE) module is one type of Bluetooth module 32 well equipped to handle this task. Panasonic has developed the PAN1740 BLE Module as one example. The embodiment as shown in FIGS. 6-10 illustrates leveraging this type of Bluetooth module 32. A microprocessor 35 is housed within the sprocket shell housing 18 for processing commands received by Bluetooth signals or infrared signals that are transmitted from the Bluetooth module 32 and infrared receiver module 22. The microprocessor 35 used in one design is made by Microchip that is an IC, PIC 8-bit, 64 KB, Flash, 28SSOP as part of the product description provided by Microchip; however, other microprocessors 35 may be used. The Bluetooth module 32 is in proximate relationship to the infrared receiver module 22. Both the Bluetooth module 32 and the infrared receiver module 22 are in operational relationship to the microprocessor 35 by means of a printed circuit board 36.

The sprocket command assembly 24 or logic board resides in an operational relationship to the Bluetooth module 32 and receives data from the Bluetooth module 32 via the printed circuit board 36. The data is then processed by the microprocessor 35 within the sprocket command assembly 24 or logic board to deliver an output signal via an electrical current to activate the infrared LED emitter 34. In this manner, the infrared LED emitter 34 resides in an operational relationship to the microprocessor 35 by means of the printed circuit board 36. The infrared LED emitter 34 resides in a transponding position 38 to transmit infrared LED signal to an IR receiver of the electronic device 37 that resides outside of the sprocket shell housing 18 and sprocket lid 20. The transponding position 38 may be internal to the sprocket shell housing 18 and sprocket lid 20; however, it is preferred that an emitter sprocket window 39 is provided to allow the transmission of the infrared LED signal from the infrared LED emitter 34. In an alternative embodiment, a lid sprocket window 40 resides on the sprocket lid 20 to allow the receipt of an infrared LED signal from outside the sprocket to the infrared receiver module 22. In this embodiment, the at least one sprocket 14 can learn from a standard IR remote as shown in FIG. 10 by receiving the remote infrared signal 21 from the standard IR remote by the infrared receiver module 22 found on the sprocket command assembly 24. The lid sprocket window 40 may also be the corresponding sprocket lid 20 itself so long as the corresponding sprocket lid 20 is at least partly transparent to allow for the receipt of the remote infrared signal 21 from outside the at least one sprocket 14 by the infrared receiver module 22.

In the optional embodiment, the infrared LED emitter 34 resides outside of the sprocket shell housing 18 and sprocket lid 20. As shown in FIG. 6, the infrared LED emitter 34 extends at least partially outside of the sprocket shell housing 18 and the corresponding sprocket lid 20 through an infrared LED emitter opening 42. The infrared LED emitter opening is created by a front end depression 41 of said sprocket shell housing 18 and a front end cavity 43 of the corresponding sprocket lid 20. The infrared LED emitter 34 is used to send commands to the electronic device 12 that has the IR receiver to receive the commands originating from the Bluetooth remote 16. The infrared LED emitter 34 sprays an infrared signal about 0.1 inches to about 18 inches because of the low amperage and power available from the sprocket power source 33. As such, it is important that the at least one sprocket 14 resides within about 0.1 inches to 18 inches from the IR receiver of the electronic device 37 and more preferably, within about 0.1 inches to about 4 inches from the IR receiver of the electronic device 37.

A sprocket power source 33 is provided to deliver power to the Bluetooth module 32, the sprocket command assembly 24 and infrared LED emitter 34. The sprocket power source 33 is in an electrical relationship with the microprocessor 35 via the sprocket command assembly 24. The sprocket power source 33 may be an electrical cord running to a power supply external from the sprocket shell housing 18 and sprocket lid 20. In the preferred embodiment, the sprocket power source 33 is provided by a sprocket battery 44 that resides internal to the sprocket shell housing 18 and sprocket lid 20. The battery case 28 secures the sprocket battery 44 to the sprocket command assembly 24. Panasonic makes a useable lithium ion battery that works well as the sprocket battery 44. The Panasonic battery is given the identification number ECR2032 which is a Lithium coin, 3V, 20 mm, 240 mAh battery. The sprocket battery 44 may be a rechargeable battery or a one-time use battery. A lithium ion battery that is rechargeable using a microUSB port is the most preferred battery because it allows the user of the at least one sprocket 14 to continuously use the at least one sprocket 14 after the battery charge has been depleted.

When the at least one sprocket 14 is shipped and stored, the sprocket battery 44 needs to be protected until it is ready for use by the consumer to preserve the battery life. As such, it is preferred that the at least one sprocket 14 is designed to accommodate a battery pull tab 45 as shown in FIG. 7. The battery pull tab 45 is inserted in such a manner to prevent either the positive or negative end of the sprocket battery 44 from coming into contact with an electrically conducting element of the sprocket command assembly 24. However, the pull tab 45 must be removeable without the need to open the at least one sprocket 14. To achieve this action, the sprocket shell housing 18 is provided with a rear end depression 46. The rear end depression 46 is shaped to accommodate the battery pull tab 45 and may be in the shape of a semicircle, rectangle or other accommodating shape.

The at least one sprocket 14 is further provided with a mounting component 47. The mounting component 47 may reside on a side of the at least one sprocket that has the infrared LED emitter 34 as shown in FIG. 4. The rational for this is that the side of the at least one sprocket 14 faces the IR receiver of the electronic device 37 in this embodiment. In an alternative embodiment, the mounting component 47 may reside on a side that is adjacent to a side with the infrared LED emitter 34 as shown in FIG. 6. The mounting component 46 may be an adhesive grip (I.e. glue, sticky polymer, etc.), a suction cup, a magnet or other means of adhering to the electronic device. The mounting component 47 should not interfere with the line of sight from the infrared LED emitter 34 and the IR receiver of the electronic device 37. In an optional embodiment, a tape or bandaid-like material could be used as the mounting component 47 to adhere the at least one sprocket 14 to the electronic device by covering a front end of the at least one sprocket 14 and adhering to the edges of the at least one sprocket 14. In the most preferred embodiment, the mounting component 47 is found on a bottom, outside surface 48 of the sprocket shell housing 18 (see FIGS. 4, 8 and 9). In another optional embodiment, GeckSkin™ may be employed so that the at least one sprocket 14 may be made to mount either permanently or for a select period of time.

To assist with communicating to the user that the at least one sprocket 14 is still working properly, the sprocket command assembly 24 is optionally provided with an activity indicator 49 in operational relationship to the microprocessor 35. The activity indicator 49 is typically some type of light such as an LED light that activates when the microprocessor 35 is engaged. The activated LED light can be seen by the user through the lid sprocket window 40 or the sprocket lid 20 if the sprocket lid 20 is at least partially transparent.

An optional addition to the sprocket command assembly 24 is a reverse voltage protector 50. The reverse voltage protector 50 resides in electrical relationship with the sprocket power source 33 to protect the modules on the printed circuit board 36 from being damaged in the event current attempts to move in a reverse direction. This may happen if the sprocket battery 44 is accidentally put in place in the wrong direction causing reverse polarity in the circuit.

Now referring to FIG. 5, the Bluetooth remote 16 is provided with a Bluetooth remote power source (not shown), a software application 51 for providing command logic to said Bluetooth remote 16, and a Bluetooth signal transmitter (not shown). The Bluetooth remote 16 may be a wireless device such as a tablet, mobile phone or laptop. The Bluetooth remote 16 may be a wired device such as a computer. Most Bluetooth remotes 16 will have a Bluetooth remote power source already embedded such as a battery or electrical cord. The Bluetooth signal transmitter is also included in these devices; however, a Bluetooth signal transmitter may be added on later as an optional feature if the Bluetooth signal transmitter does not come standard on the Bluetooth remote 16. To enable the Bluetooth remote 16 to send a Bluetooth signal to the at least one sprocket 14, logic code in the form of the software application 51 must be uploaded into the Bluetooth remote 16. The logic code can be downloaded by the user in the form of an app (short for application) on an android, iOS or Windows® operating system supported device that provides command logic to the Bluetooth remote 16. The app includes the logic code. When the app is downloaded, the user can select from a list of electronic devices 12 that can be used with the at least one sprocket 14. The electronic devices might include "televisions" as an option and the user would select this option and then select from a list of television brands to narrow the field of the at least one sprocket's compatibility. Once the television brand has been selected, additional options may be required such as a model number of the television brand. Once the final electronic device has been selected, the app will be able to reprogram the at least one sprocket 14 to transmit a compatible infrared LED signal to the IR receiver of the electronic device 37 such that commands will be received as if the commands were coming from an Original Equipment Manufacturer infrared remote.

The app may also be provided with behavioral capturing logic. The advantage of the behavioral capturing logic is that the user may be provided with a more user friendly experience on the app. Thus, for example, if a user enjoys a particular television program that is on at a particular hour of the day of a particular day or days of the week, the app can remember that information and tag the user data. The app automatically learns user habits and can provide the user with a one button feature to select the show for enjoyment. This similar principal can also be applied to radio stations, sound preferences of an equalizer or light preference of a room. Sample logic can be pulled from open source or may be customized, but the logic would be similar to a sound print used for tagging audio data.

Now referred to FIG. 5, the app and the Bluetooth remote 16 can send commands to two or more wireless sprockets directly and independently. What makes the wireless network 10 unique, among other things, is that the at least one sprockets 14 can operate independently without additional wires or plugs. Commands may be sent via the Bluetooth remote 16 that may be specific to a particular electronic device 12 such as a stereo and the at least one sprocket 14 that is associated and synched with the stereo will provide commands to the stereo directly. If a second or third at least one sprocket 14 is placed on or near a second or third electronic device 12 such as a television, then commands that are specific to the second or third electronic device 12 will only apply to the at least one sprocket 14 associated and synched with that second or third electronic device 12. Having the at least one sprockets 14 wireless makes it easy to place multiple at least one sprockets 14 throughout a room on or near multiple electronic devices 12. Optionally, if one sprocket 14 can be positioned to feed an infrared signal to a plurality of electronic devices 12 (or more specifically, the IR receivers of the electronic devices 37) from the infrared LED emitter 34 of the one sprocket 14, then the one sprocket 14 can receive commands from the Bluetooth remote 16 to operate those electronic devices 12 on its own. An example would be where if one sprocket 14 could be placed such that the IR receivers of a television and cable box could receive the infrared signal from the one sprocket 14, and a second sprocket 14 could be used to independently operate a stereo and an accompanying DVD player if the IR receivers of those electronic devices were positioned to receive the infrared signal of the second sprocket 14.

While a particular embodiment of the wireless network has been described herein, it will be appreciated by those skilled in the art that changes and modifications may be made thereto without departing from the invention in its broader aspects and as set forth herein.

We claim:

1. A wireless network for providing commands to a plurality of electronic devices that receive an infrared signal, wherein said wireless network comprises:

a first sprocket and a second sprocket for receiving a wireless transmission command via Bluetooth signals and infrared signals, wherein each said first sprocket and said second sprocket are comprised of a sprocket shell housing, wherein said sprocket shell housing is provided with a lower sprocket command assembly support tab and a corresponding sprocket lid is provided with an upper sprocket command assembly support tab, said corresponding sprocket lid is attached to said sprocket shell housing, and a sprocket command assembly that is housed by said sprocket shell housing and said corresponding sprocket lid, said sprocket command assembly comprising:

a microprocessor housed within said sprocket shell housing for processing commands received by Bluetooth signals or infrared signals, a Bluetooth module in proximate relationship to an infrared receiver module in operational relationship to said microprocessor by a printed circuit board, an infrared LED emitter in operational relationship to said microprocessor by said printed circuit board, and a sprocket power source in electrical relationship with said microprocessor, said Bluetooth module and said infrared LED emitter;

wherein said first sprocket is configured to transmit a first infrared signal specific to a first electronic device and said second sprocket is configured to transmit a second infrared signal specific to a second electronic device; and a Bluetooth remote for sending said Bluetooth signal to said first sprocket and said second sprocket, wherein said Bluetooth remote is provided with a Bluetooth remote power source, a software application for providing command logic to said Bluetooth remote, and a Bluetooth signal transmitter.

2. The wireless network in claim 1, wherein each said first sprocket and said second sprocket is further provided with a mounting component such that said first sprocket and said second sprocket are mountable in a vertical relationship on said first electronic device and on said second electronic device.

3. The wireless network in claim 1, wherein said mounting component is an adhesive grip found on a bottom, outside surface of said sprocket shell housing.

4. The wireless network in claim 1, wherein said first sprocket and said second sprocket is further provided with a sprocket window to allow the receipt of an infrared LED signal from outside the sprocket to said infrared receiver module.

5. The wireless network in claim 1, wherein said corresponding sprocket lid is at least partly transparent to allow for the receipt of an infrared LED signal from outside the sprocket to said infrared receiver module.

6. The wireless network in claim 1, wherein said infrared LED emitter extends at least partially outside of said sprocket shell housing and said corresponding sprocket lid through an infrared LED emitter opening.

7. The wireless network in claim 6, wherein said infrared LED emitter opening is created by a front end depression of said sprocket shell housing and a front end cavity of said corresponding sprocket lid.

8. The wireless network in claim 1, wherein said sprocket shell housing is provided with a set of stabilizing ribs that correspond to a battery case designed to house said sprocket power source.

9. The wireless network in claim 1, wherein said sprocket shell housing is provided with a rear end depression.

10. The wireless network in claim 9, wherein said rear end depression is shaped to accommodate a battery pull tab.

11. The wireless network in claim 1, wherein said corresponding sprocket lid is attached to said sprocket shell housing by a snap fit ring and a corresponding snap fit impression.

12. A wireless network comprising:

a first sprocket and a second sprocket in operational relationship to a remote for receiving a wireless transmission command via Bluetooth signals and infrared signals, wherein each said first sprocket and said second sprocket are comprised of a sprocket shell housing, a corresponding sprocket lid is attached to said sprocket shell housing, and a sprocket command assembly that is housed by said sprocket shell housing and said corresponding sprocket lid, said sprocket command assembly comprising a lower sprocket command assembly support tab and said corresponding sprocket lid is provided with an upper sprocket command assembly support tab, said sprocket command assembly comprising:

a microprocessor housed within said sprocket shell housing for processing commands received by Bluetooth signals or infrared signals, a Bluetooth module in proximate relationship to an infrared receiver module in operational relationship to said microprocessor by a printed circuit board, an infrared LED emitter in operational relationship to said microprocessor by said printed circuit board, and a sprocket power source in electrical relationship with said microprocessor, said Bluetooth module and said infrared LED emitter;

an IR receiver of a first electronic device for receiving an infrared signal from said first sprocket via a first infrared LED emitter and an IR receiver of a second electronic device for receiving an infrared signal from said second sprocket via a second infrared LED emitter; and where said remote sends said Bluetooth signal to said first sprocket and said second sprocket, wherein said remote is provided with a Bluetooth remote power source, a software application for providing command logic to said remote, and a Bluetooth signal transmitter.

13. The wireless network in claim 12, wherein said first sprocket and said second sprocket reside within 0.01 inches and 18 inches of said IR receiver of said electronic device.

14. The wireless network in claim 13, wherein said first sprocket is mounted on said first electronic device and said second sprocket is mounted on said second electronic device.

15. A wireless network for providing commands to a plurality of electronic devices that receive an infrared signal, wherein said wireless network comprises:

a first sprocket and a second sprocket for receiving a wireless transmission command via Bluetooth signals or infrared signals, wherein each said first sprocket and said second sprocket are comprised of a sprocket shell housing, a corresponding sprocket lid is attached to said sprocket shell housing, and a sprocket command assembly that is housed by said sprocket shell housing, said sprocket command assembly comprising a lower sprocket command assembly support tab and said corresponding sprocket lid is provided with an upper sprocket command assembly support tab, said sprocket command assembly comprising:

a microprocessor housed within said sprocket shell housing for processing commands received by Bluetooth signals or infrared signals, a Bluetooth module in proximate relationship to an infrared receiver module in operational relationship to said microprocessor, an infrared LED emitter in operational relationship to said microprocessor, and a sprocket power source in electrical relationship with said microprocessor, said Bluetooth module and said infrared LED emitter;

wherein said first sprocket is configured to transmit a first infrared signal specific to a first electronic device and said second sprocket is configured to transmit a second infrared signal specific to a second electronic device; and a Bluetooth remote for sending said Bluetooth signal to said first sprocket and said second sprocket, wherein said Bluetooth remote is provided with a Bluetooth remote power source, a software application for providing command logic to said Bluetooth remote, and a Bluetooth signal transmitter.

* * * * *